US009646484B2

(12) United States Patent
Fiedler et al.

(10) Patent No.: US 9,646,484 B2
(45) Date of Patent: May 9, 2017

(54) INTELLIGENT SMOKE SENSOR

(71) Applicant: Fibar Group sp. z o.o., Poznan (PL)

(72) Inventors: Maciej Fiedler, Poznan (PL); Bartlomiej Arcichowski, Poznan (PL); Adam Pudlowski, Kutno (PL)

(73) Assignee: FIBAR GROUP S.A., Poznan (PL)

( * ) Notice: Subject to any disclaimer, the term of this patent is extended or adjusted under 35 U.S.C. 154(b) by 0 days.

(21) Appl. No.: 14/494,730

(22) Filed: Sep. 24, 2014

(65) Prior Publication Data

US 2015/0084765 A1 Mar. 26, 2015

Related U.S. Application Data

(60) Provisional application No. 61/881,808, filed on Sep. 24, 2013.

(51) Int. Cl.

| | |
|---|---|
| ***G08B 29/00*** | (2006.01) |
| ***G08B 25/10*** | (2006.01) |
| ***G08B 17/00*** | (2006.01) |

(52) U.S. Cl.

CPC ..... *G08B 25/10* (2013.01); *G08B 17/00* (2013.01)

(58) Field of Classification Search

CPC ..... C09D 175/04; C09D 5/086; C09D 5/14; C08L 2666/36; A24D 3/04; A61J 3/07; A61K 38/17; A61K 48/00; B29C 63/26; B65D 83/48; C07K 14/4702; C23C 18/208; C23C 18/24; C23C 18/285; C23C 18/30

USPC ..... 340/506, 539.22, 539.17, 501, 517, 521, 340/628, 577, 539.1, 514, 602, 692, 332, 340/286.05

See application file for complete search history.

(56) References Cited

U.S. PATENT DOCUMENTS

| | | | |
|---|---|---|---|
| 3,873,927 | A | 3/1975 | Overall |
| D301,869 | S | 6/1989 | Schwartz |
| D325,902 | S | 5/1992 | Hudson et al. |
| D334,561 | S | 4/1993 | Crater et al. |

(Continued)

FOREIGN PATENT DOCUMENTS

| | | |
|---|---|---|
| AU | 2009100570 A4 | 7/2009 |
| CA | 70745 | 6/1992 |

(Continued)

OTHER PUBLICATIONS

Int'l Search Report and Written Opinion for PCT/IB2014/002752 dated Apr. 10, 2015.

(Continued)

*Primary Examiner* — Daniel Previl

(74) *Attorney, Agent, or Firm* — McAndrews, Held & Malloy, Ltd.

(57) ABSTRACT

Method and/or system for an intelligent smoke sensor may comprise a sensor system configured to detect at least one of a plurality of predefined conditions, a processor coupled to the sensor system. The processor may be configured to generate an alarm indication in response to having detected at least one predefined condition. The intelligent smoke sensor system may comprise a recorder coupled to the processor. The recorder may be configured to record the alarm indication and the detected predefined conditions. The intelligent smoke sensor may comprise communication circuitry that mat be configured to communicate the alarm indication and the detected predefined condition to the network.

3 Claims, 3 Drawing Sheets

(56) References Cited

U.S. PATENT DOCUMENTS

D349,687 S 8/1994 Khoo et al.
5,335,536 A * 8/1994 Runnevik ..... G01M 3/20 73/40.7
D359,043 S 6/1995 Althans
D381,633 S 7/1997 Hiyakumoto et al.
D396,471 S 7/1998 Kolinen
D402,909 S 12/1998 Stanuch
D405,424 S 2/1999 Winkler et al.
D417,871 S 12/1999 Hisatsune
6,597,288 B2 * 7/2003 Amano ..... G08B 17/06 340/522
D481,056 S 10/2003 Kawasaki et al.
D487,728 S 3/2004 Murray
D489,337 S 5/2004 Murray
D492,262 S 6/2004 Murray
D494,583 S 8/2004 Guerrera
6,892,751 B2 5/2005 Sanders
D513,497 S 1/2006 Whitehouse
D514,118 S 1/2006 Christianson
D520,500 S 5/2006 Storti et al.
D521,403 S 5/2006 Shain et al.
D523,873 S 6/2006 Huang
D533,186 S 12/2006 Chen et al.
D533,851 S 12/2006 Yoon
D540,752 S 4/2007 Hayes et al.
7,206,645 B2 4/2007 Seguin
D541,762 S 5/2007 Nakagawa e
D548,702 S 8/2007 Girard
7,253,741 B2 8/2007 Fiorletta et al.
7,309,216 B1 12/2007 Spadola, Jr. et al.
D559,233 S 1/2008 Tang
D567,187 S 4/2008 Oba et al.
D570,297 S 6/2008 Gibbons et al.
D588,484 S 3/2009 Bandringa et al.
D604,254 S 11/2009 Lanfear et al.
D604,725 S 11/2009 Chen
D609,701 S 2/2010 Hou
D610,479 S 2/2010 Shi
D621,287 S 8/2010 Kaneko et al.
D631,165 S 1/2011 Fisher et al.
D631,446 S 1/2011 Lanfear et al.
D638,372 S 5/2011 Clymer et al.
D639,752 S 6/2011 Li et al.
D646,640 S 10/2011 Clymer et al.
D647,504 S 10/2011 Choi
8,154,398 B2 4/2012 Rolf et al.
D660,261 S 5/2012 Huang et al.
D660,809 S 5/2012 Kern Koskela et al.
D664,460 S 7/2012 Aurongzeb et al.
D665,290 S 8/2012 Bhate et al.
D665,773 S 8/2012 Behringer
D671,851 S 12/2012 Treharne et al.
D678,097 S 3/2013 Elwell et al.
D678,258 S 3/2013 Seto
D680,015 S 4/2013 Hauser et al.
D682,777 S 5/2013 Gupta et al.
D683,251 S 5/2013 Dumas et al.
D689,441 S 9/2013 Kah, Jr. et al.
8,539,567 B1 * 9/2013 Logue ..... H04L 63/0884 709/223
D692,332 S 10/2013 Ni et al.
D693,311 S 11/2013 Biller et al.
D695,234 S 12/2013 Santiago
D695,693 S 12/2013 Lee et al.
8,635,373 B1 * 1/2014 Supramaniam ..... H04L 67/42 709/228
D699,177 S 2/2014 Higashi
D703,156 S 4/2014 Parsons et al.
D703,566 S 4/2014 Chen et al.
D704,625 S 5/2014 Tsutsumi et al.
D705,719 S 5/2014 Wong
D706,152 S 6/2014 Ni et al.
D706,228 S 6/2014 Ishiura
8,836,522 B2 9/2014 Thorpe et al.
2005/0135570 A1 * 6/2005 Binning ..... H04L 12/2803 379/45
2005/0242948 A1 * 11/2005 Tarr ..... G08B 25/009 340/539.22
2008/0133063 A1 6/2008 Bisson et al.
2009/0212936 A1 * 8/2009 Granatelli ..... G05B 23/0262 340/506
2009/0231129 A1 * 9/2009 Edwards ..... G08B 25/14 340/540
2009/0240377 A1 9/2009 Batzler et al.
2011/0012726 A1 1/2011 Jessiman et al.
2011/0061014 A1 3/2011 Frader-Thompson et al.
2011/0093217 A1 * 4/2011 Kates ..... G01N 27/048 702/24
2011/0130880 A1 6/2011 Nishino et al.
2011/0289561 A1 11/2011 Ivanov et al.
2012/0130513 A1 5/2012 Hao et al.
2012/0212341 A1 * 8/2012 Siber ..... G08B 27/005 340/539.17
2013/0082835 A1 4/2013 Shapiro et al.
2013/0103207 A1 * 4/2013 Ruff ..... G05D 23/1902 700/278
2013/0145826 A1 6/2013 Richarz et al.
2013/0241479 A1 9/2013 Wright, Jr. et al.
2014/0005809 A1 1/2014 Frei et al.
2014/0354425 A1 12/2014 Siber et al.

FOREIGN PATENT DOCUMENTS

CA 74034 3/1994
CA 74569 8/1994
CA 74610 8/1994
CN 3274285 1/2003
CN 301936325 S 5/2012
CN 102598076 A 7/2012
CN 201230432179X 6/2013
CN 302767627 S 3/2014
DE 4029615 A1 4/1992
DE 102009046096 A1 5/2011
EP 0241676 A2 10/1987
EP 000137351-0008 2/2004
EP 000145644-0001 3/2004
EP 000166350-0001 4/2004
EP 000242888-0001 10/2004
EP 000253380-0002 11/2004
EP 000268032-0002 12/2004
EP 000321971-0007 4/2005
EP 000352943-0001 6/2005
EP 000481304-0001 2/2006
EP 000536438-0001 5/2006
EP 000603709-0002 10/2006
EP 000623608-0001 11/2006
EP 000757620-0004 7/2007
EP 000779061-0001 8/2007
EP 000792791-0001 9/2007
EP 000827118-0001 11/2007
EP 000830542-0006 11/2007
EP 000883269-0001 2/2008
EP 001015788-0001 10/2008
EP 001032437-0001 11/2008
EP 001032437-0002 11/2008
EP 001057392-0001 12/2008
EP 001223457-0002 6/2010
EP 001720590-0001 6/2010
EP 001781188-0001 11/2010
EP 001259204-0001 2/2011
EP 001828070-0001 2/2011
EP 001295182-0001 9/2011
EP 001914029-0004 9/2011
EP 001920018-0004 9/2011
EP 002041764-0001 5/2012
EP 002074989-0001 7/2012
EP 002079673-0001 7/2012
EP 2494532 A1 9/2012
EP 002143784-0002 11/2012
EP 002163360-0001 1/2013
EP 002177667-0001 2/2013
EP 002242800-0001 5/2013

(56) References Cited

FOREIGN PATENT DOCUMENTS

| | | | |
|---|---|---|---|
| EP | 002278887-0001 | | 7/2013 |
| EP | 002293415-0002 | | 8/2013 |
| EP | 002440198-0001 | | 4/2014 |
| EP | 002465476-0002 | | 5/2014 |
| JP | 1177905 | S | 6/2003 |
| JP | 1203574 | S | 4/2004 |
| JP | 1220720 | S | 10/2004 |
| JP | 1333401 | S | 6/2008 |
| JP | 1348157 | S | 1/2009 |
| JP | 1400836 | S | 11/2010 |
| JP | 1422635 | S | 9/2011 |
| JP | 1463123 | S | 2/2013 |
| JP | 1491697 | S | 3/2013 |
| JP | 1386160 | S | 4/2013 |
| JP | 1471658 | S | 6/2013 |
| JP | 1475417 | S | 7/2013 |
| JP | 1477025 | S | 8/2013 |
| JP | 1477336 | S | 8/2013 |
| JP | 1400674 | S | 10/2013 |
| JP | 1498774 | S | 6/2014 |
| WO | DM053972 | | 11/2000 |
| WO | DM/058681 | | 11/2001 |
| WO | DM059634 | | 3/2002 |
| WO | DM066764 | | 5/2005 |
| WO | DM/074389 | | 9/2010 |
| WO | DM074708 | | 11/2010 |
| WO | DM075611 | | 12/2010 |
| WO | DM075517 | | 2/2011 |
| WO | 2011051022 | A1 | 5/2011 |
| WO | DM076583 | | 5/2011 |
| WO | DM078408 | | 11/2011 |
| WO | DM079061 | | 2/2012 |
| WO | DM078643 | | 6/2012 |
| WO | DM078737 | | 7/2012 |
| WO | DM079877 | | 12/2012 |
| WO | DM081654 | | 8/2013 |
| WO | DM082066 | | 10/2013 |
| WO | DM083551 | | 2/2014 |

OTHER PUBLICATIONS

Automated Home, Case Study: UK Z-Wave Home Automation Setup, www.automatedhome.co.uk/installaton/case-study-uk-z-wave-home-automation-setup.html (13 pages), Jun. 17, 2014.

The Online Architecture and Design Exhibition, Interface Module for Home Automation System—EXB-REL8—AMX—Videos, www.archiexpo.com/prod/amx/interface-module-home-automation-systems-51274-1065061.html (18 pages), Jun. 17, 2014.

Graves on SOHO Technology, Vera Home Automation, Michael Graves, Oct. 23, 2008, www.mgraves.org/2008/10/vera-home-automation/ (6 pages), Jun. 17, 2014.

TaHomA—Home Motion by Somfy, Somfy Systems, Creator of TaHomA, the New Home Control System, www.somfytahoma.com/home-automation-products/home-automation-controllers-products/home-automation-somfy--tahoma-controller (3 pages), Jun. 17, 2014.

Introduction to X10 Home Automation Technology, by Tony Northrup, Jan. 10, 2005, www.oreillynet.com/pub/a/network/2005101/10/x10_hmhck.html (5 pages), Jun. 17, 2014.

Wireless Leakage Sensor URL: http://smarthome01.com/2014/03/03/wireless-leakage-sensor/.

* cited by examiner

INTELLIGENT SMOKE SENSOR

CLAIM OF PRIORITY/INCORPORATION BY REFERENCE

This patent application makes reference to, claims priority to and claims benefit from U.S. Provisional Patent Application Ser. No. 61/881,808 entitled "Intelligent Smoke Sensor" filed on Sep. 24, 2013, which is hereby incorporated herein by reference in its entirety.

TECHNICAL FIELD

Aspects of the present disclosure relate to electronic systems and/or networking More specifically, certain implementations of the present disclosure relate to an intelligent smoke sensor.

BACKGROUND

Existing methods and systems for providing smoke detection can be costly, cumbersome and inefficient. Further limitations and disadvantages of conventional and traditional approaches will become apparent to one of skill in the art, through comparison of such approaches with some aspects of the present method and apparatus set forth in the remainder of this disclosure with reference to the drawings.

BRIEF SUMMARY

A system and/or method is provided for an intelligent smoke sensor, substantially as shown in and/or described in connection with at least one of the figures, as set forth more completely in the disclosure and/or the claims.

These and other advantages, aspects and novel features of the present disclosure, as well as details of illustrated implementation(s) thereof, will be more fully understood from the following description and drawings.

DETAILED DESCRIPTION

Figure 1:
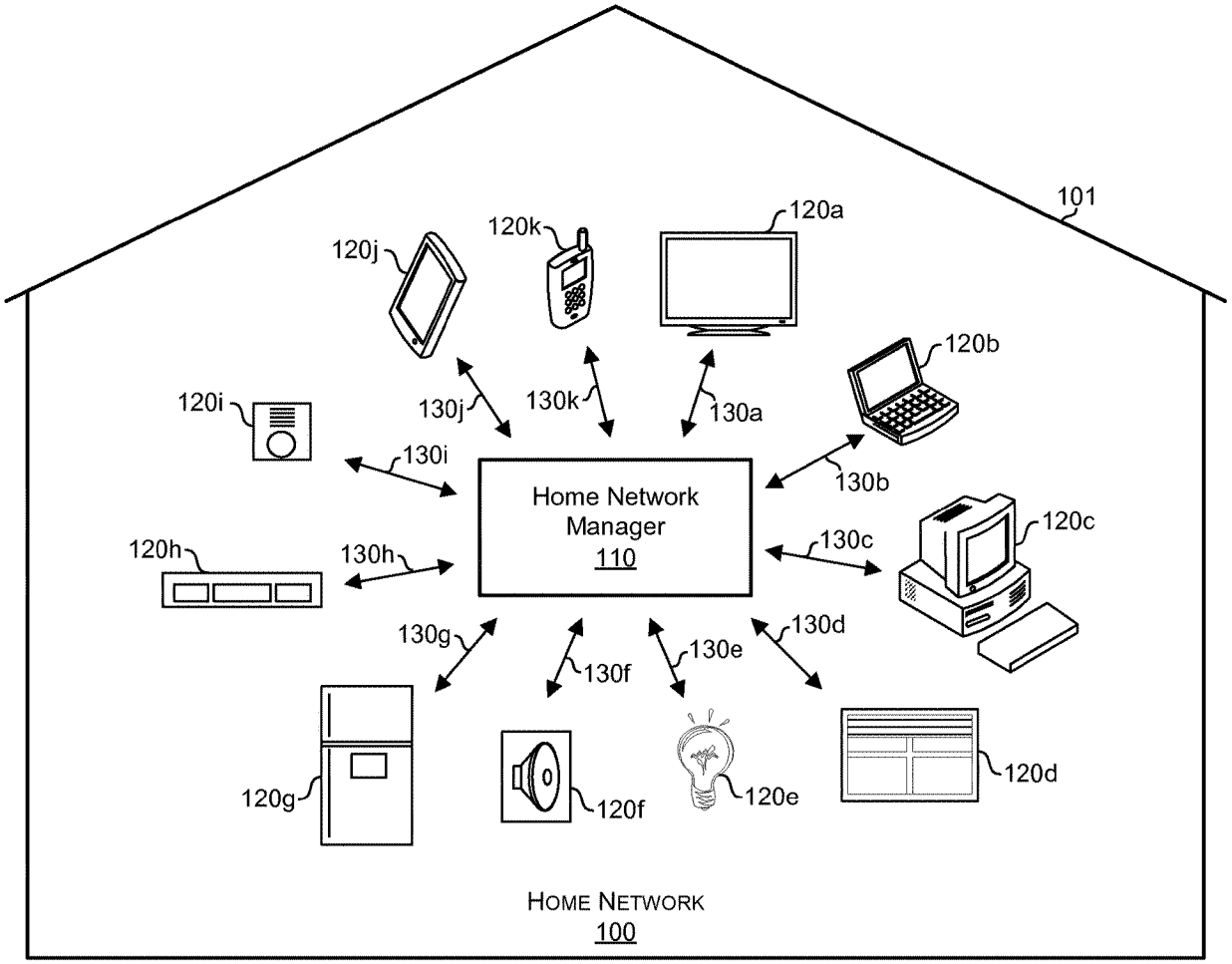
FIG. 1 illustrates an example home network.

Certain implementations may be found in a method and system for an intelligent smoke sensor. An exemplary embodiment provides an intelligent smoke detecting system for use in a network. The intelligent smoke detecting system includes a sensor system to detect at least one of a plurality of predefined conditions. The intelligent smoke detecting system also includes a processor coupled to the sensor system to generate an alarm indication in response to the sensor system having detected at least one of the predefined conditions. The intelligent smoke detecting system also includes a recorder coupled to the processor to record the alarm indication and the detected at least one of the predefined conditions, and a communication circuitry to communicate the alarm indication and the detected at least one of the predefined conditions to the network.

Another exemplary embodiment provides an intelligent smoke detecting system for use in a network. The intelligent smoke detecting system includes a device communicatively coupled to the network, and a network manager communicatively coupled to the device to communicate control signals via the network. The intelligent smoke detecting system also includes an intelligent smoke sensor communicatively coupled to the network manager via the network. The intelligent smoke sensor houses therein a sensor system to detect at least one of a plurality of predefined conditions, a processor coupled to the sensor system to generate an alarm indication in response to the sensor system having detected at least one of the predefined conditions, and a recorder coupled to the processor to record the alarm indication and the detected at least one of the predefined conditions, and a communication circuitry to communicate the alarm indication to the network manager via the network. The network manager further communicates the control signals to the device in response to receiving the alarm indication. The device is activated in response to receiving the control signals.

Another exemplary embodiment provides a method of controlling a device via a) an intelligent smoke detecting system being remote from the device, and b) a network manager operable to communicate control signals to the device. The method includes detecting at the intelligent smoke detecting system at least one of a plurality of predefined conditions. In response to having detected the at least one of the predefined conditions, the method includes generating an alarm indication, recording the alarm indication and the at least one of the predefined conditions, and communicating the alarm indication from the intelligent smoke detecting system to the network manager. The method also includes communicating the control signals from the network manager to the device in response to the network manager receiving the alarm indication, and activating the device in response to receiving the control signals.

As utilized herein the terms "circuits" and "circuitry" refer to physical electronic components (i.e. hardware) and any software and/or firmware ("code") which may configure the hardware, be executed by the hardware, and/or otherwise be associated with the hardware. As used herein, for example, a particular processor and memory may comprise a first "circuit" when executing a first plurality of lines of code and may comprise a second "circuit" when executing a second plurality of lines of code. As utilized herein, "and/or" means any one or more of the items in the list joined by "and/or". As an example, "x and/or y" means any element of the three-element set {(x), (y), (x, y)}. As another example, "x, y, and/or z" means any element of the seven-element set {(x), (y), (z), (x, y), (x, z), (y, z), (x, y, z)}. As utilized herein, the terms "block" and/or "module" refer to functions than may be performed by one or more circuits. As utilized herein, the term "example" means serving as a non-limiting example, instance, or illustration. As utilized herein, the terms "for example" and "e.g." introduce a list of one or more non-limiting examples, instances, or illustrations. As utilized herein, circuitry is "operable" to perform a function whenever the circuitry comprises the necessary hardware and code (if any is necessary) to perform the function, regardless of whether performance of the function is disabled, or not enabled, by some user-configurable setting.

FIG. 1 illustrates an example home network. Referring to FIG. 1, there is shown a home network 100.

The home network 100 may correspond to a location 101. The location 101 may, for example, correspond to a residence (e.g., home, apartment) or non-residence premises (e.g., a small business, a school, a library). In this regard, the home network 100 may, for example, comprise a plurality of home network elements, such as, for example, a plurality of home network elements 120*a*-120*k*. The home network elements (e.g., home network elements 120*a*-120*k*) may, for example, comprise one or more devices, systems, fixtures, appliances, and/or other circuitry. The home network elements (e.g., home network elements 120*a*-120*k*) may comprise, for example, one or more televisions 120*a*, one or more computers (e.g., laptop computer 120*b*, desktop computer 120*c*), one or more personal handheld devices (e.g., tablet 130*j*, mobile phone 130*k*), one or more multimedia devices and/or components (e.g., speakers 120*f*), one or more structural fixtures (e.g., windows/window blinds 120*d*), one or more lighting and/or electrical fixtures 120*e*, one or more appliances (e.g., refrigerator 120*g*), one or more environmental sensory devices 120*h* (e.g., thermometers, humidity meters), and/or one or more security devices 120*i* (e.g., a smoke detector, a carbon monoxide detector, a security alarm, a motion detector).

The disclosure is not limited to any particular type of a home network. Furthermore, the disclosure is not limited to any particular combination of home network elements. It is to be understood that although the network is referred to as a "home network" throughout the disclosure, the disclosure is not limited in this way. Specifically, the network may comprise any other network that may be operable to control one or more network elements.

In some instances, the home network 100 may incorporate a home network manager 110. The home network manager 110 may comprise suitable circuitry, interfaces, logic, and/or code for implementing various aspects of the present disclosure. For example, the home network manager 110 may be configured for use in managing, servicing, and/or interacting with one or more home network elements. Although the home network manager 110 is shown in FIG. 1 as a single and separate device, the disclosure is not limited in this way. For example, in some implementations, one or more functions of the home network manager 110 may be provided by one or more existing home network elements (e.g., providing user interface via tablet 120*j* and/or television 120*a*). In an example embodiment of the disclosure, the home network manager 110 may be implemented as a virtual platform, such as, for example, one or more software modules may run on, and/or utilize resources of one or more existing home network elements (e.g., laptop 120*b* or desktop 120*c*).

The home network manager 110 may be configured to communicate with one or more elements (e.g., home network devices) in a home network. In an example embodiment of the disclosure, the home network manager 110 may be operable to communicate with one or more devices and/or systems that may be external to a home network, using, for example, optical, wired and/or wireless communication links.

The home network manager 110 may interact with one or more of the home network elements 120*a*-120*k* via corresponding links 130*a*-130*k*, which may be supported by the home network manager 110 and/or the corresponding home network element(s). For example, the links 130*a*-130*k* may be implemented and/or configured to operate using a wireless protocol, such as, for example, a Z-wave protocol. In an example embodiment of the disclosure, the home network 100 may be implemented as Z-Wave network. However, the disclosure is not limited in this way. For example, the home network 110 may comprise one or more wired and/or wireless links and/or protocol. Wireless links and/or protocols, may comprise, for example, WPAN (e.g., Bluetooth or ZigBee) and/or WLAN (WiFi/802.11) protocols and/or any other wireless links and/or protocols suitable for implementation consistent with the disclosure. Wired protocols and/or links may comprise, for example, Ethernet, Universal Serial Bus (USB), and/or any other wired links and/or protocols suitable for implementation consistent with the disclosure.

In an example implementation of the disclosure, the home network manager 110 may be operable to support one or more communication methods from one or more home network devices (e.g., home network elements 120*a*-120*k*). For example, one or more home network elements may communicate with the home network manager 110 utilizing a particular wireless link and/or protocol (e.g., Z-wave) and/or a particular wired link and/or protocol (e.g., Ethernet), while one or more other home network elements may communicate with the home network manager 110 utilizing a different particular wireless link and/or protocol (e.g., WiFi) and/or a different particular wired link and/or protocol (e.g., USB).

In an example embodiment of the disclosure, the same one or more home network elements may communicate with the home network manager 110 by, for example, using one or more wired and/or wireless links and/or protocols at the same and/or at different times. For example, a particular network element may communicate with the home network manager 110 using a Z-Wave communication protocol for a particular communication and may communicate with the home network manager 110 using a WiFi communication protocol for another particular communication.

In operation, the home network manager 110 may be operable to manage a home network (e.g., the home network 100). The home network manager 110 may be utilized, for example, as an interface platform for interacting with various network elements (e.g., the home network elements 120*a*-120*k*). In this regard, the home network manager 110 may support establishing and/or configuring one or more communication connections/links (e.g., the links 130*a*-130*k*) with the one or more elements of the home network 110. Once established, the connectivity between the home network manager 110 and the home network elements (e.g., elements 120*a*-120*k*) may, for example, be utilized to enable centralized monitoring, control, and/or management of the home network elements, and/or of the home network 100 as a whole. For example, the home network manager 110 may be operable to control operations of certain elements (e.g., turn on television 120*a*, switch to particular channel(s) at particular days/times, and/or record if recording is supported); monitor environment in the home network, such as by obtaining environmental readings (e.g., temperature, humidity, etc.) via example environmental sensory devices 120*h*, and may process these readings (e.g., to determine if/when to adjust other home network elements accordingly); adjust one or more example lighting and/or electrical fixtures 120*e* (e.g., turn lights on or off); lower/raise example window (blinds) 120*d*; adjust operations of example appliances (e.g., refrigerator 120*g*), such as, for example, based on a pre-configured power efficiency/optimization profile; monitor for any indications of a security/safety problem, based on, for example, input from example security devices 120*i*, and/or act accordingly (e.g., send notifications to users, such as by texting example smartphone 120*k*, and/or automatically notify authorities, e.g., by dialing '911' and/or contacting pre-configured emergency numbers).

In an example embodiment of the disclosure, the home network manager 110 may provide and/or utilize user interface services in the home network. In this regard, the home network manager 110 may be operable to support use of user interface functions, and/or to generate and/or store information corresponding thereto, which may be utilized to enable interactions between the home network manager 110 and users (e.g., in the home network 100). For example, in some implementations, the home network manager 110 may be configured to generate and/or use a graphic user interface (GUI), for visually displaying information and/or providing interactivity with users (e.g., for providing input thereby). One or more user interfaces may enable configuring the home network manager 110 and/or functions provided by the home network manager 110. In an example embodiment of the disclosure, the one or more user interfaces may enable user interaction with, configuring and/or adjusting other elements in the home network 100 (e.g., elements connected to the home network manager 110).

In an example embodiment of the disclosure, the user interfaces may be provided via one or more other devices that may be communicatively coupled to the home network manager 110. For example, a GUI generated and/or used by the home network manager 110 may be displayed using existing home network elements, such as, for example, television 120*a*, laptop 120*b*, tablet 120*j*, and/or smartphone 120*k*.

In an example embodiment of the disclosure, one or more home network elements (e.g., home network elements 120*a*-120*k*) may be configured to provide enhanced functionality, especially in the context of the home network provided by home network managers (e.g., the home network manager 110). For example, rather than utilize a typical smoke detector, an enhanced (intelligent) smoke sensor may be utilized, such as to provide enhanced monitoring (e.g., better detection), improved recording of information relating thereto, and/or other functions. An example intelligent smoke sensor is depicted in and/or described with respect to FIG. 2.

Figure 2:
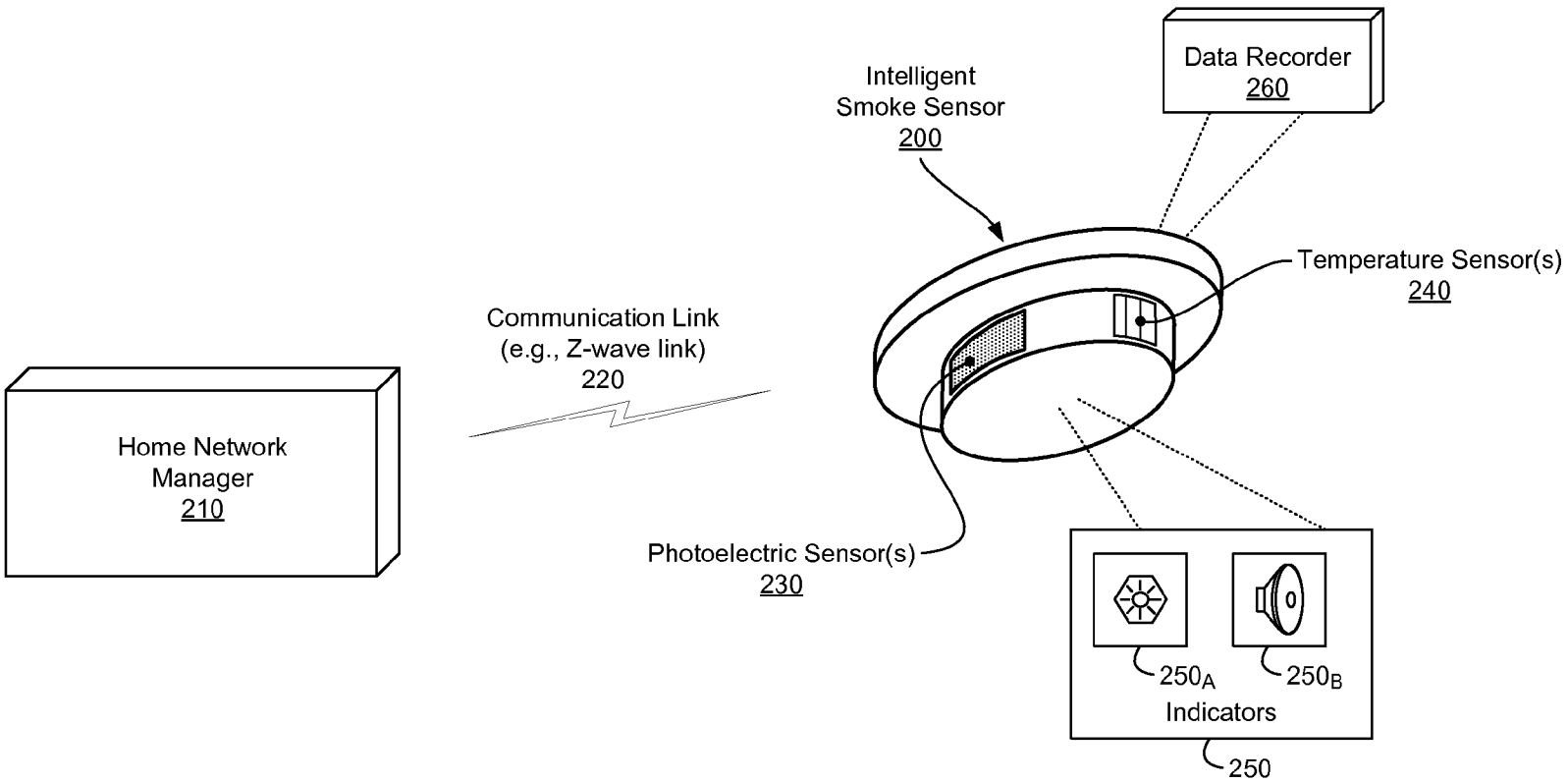
FIG. 2 illustrates an example intelligent smoke sensor.

FIG. 2 illustrates an example intelligent smoke sensor. Referring to FIG. 2, there is shown an intelligent smoke sensor 200.

The intelligent smoke sensor 200 may comprise suitable circuitry, interfaces, logic, and/or code for implementing various aspects of the present disclosure. In particular, the intelligent smoke sensor 200 may be implemented and/or configured to provide enhanced functionality, such as with respect to monitoring and/or detection of, e.g., carbon monoxide, smoke, and/or fire; and/or with respect to recording and/or maintaining of information related thereto. For example, the intelligent smoke sensor 200 may be configured for operation on a home network (e.g., home network 100 as depicted in and/or described with respect to FIG. 1), such that, the intelligent smoke sensor 200 may be utilized as a home network element. In this regard, the intelligent smoke sensor 200 may be configured to interact, for example, in a home network (e.g., home network 100 as depicted in and/or described with respect to FIG. 1) with, for example, a home network manager (e.g., network manager 210). The home network manager may be substantially similar to the home network manager 110 as depicted in and/or described with respect to FIG. 1.

For example, the intelligent smoke sensor 200 may be configured to interact with the home network manager 210 via a communication link 220. The communication link may, for example, comprise a Z-Wave link. In this regard, the intelligent smoke sensor 200 may incorporate a built-in communication transceiver (e.g., a Z-Wave transceiver) and/or related processing resources for allowing use of intelligent smoke sensor. The disclosure is not limited to any particular type of a communication link. For example, the intelligent smoke sensor 200 may be implemented to support, for example one or more wireless and/or wired links, protocols and/or connections. For example, wireless links, protocols and/or connections, may comprise, for example, WPAN (e.g., Bluetooth or ZigBee) and/or WLAN (WiFi/802.11) protocols and/or any other wireless links, protocols and/or connections suitable for implementation consistent with the disclosure. Wired links, protocols and/or connections may comprise, for example, Ethernet, Universal Serial Bus (USB), and/or any other wired links, protocols and/or connections suitable for implementation consistent with the disclosure.

In an example embodiment of the disclosure, the intelligent smoke sensor 200 may be operable to be used with any standard and/or customized alarm system, for example, by utilizing a direct and/or indirect wired connection to the alarm system (e.g., in lieu of and/or in addition to any other wired and/or wireless links and/or connections for communicating with, for example, a home network manager).

The intelligent smoke sensor 200 may incorporate various features for providing enhanced functionality and/or operations. For example, the intelligent smoke sensor 200 may be designed and/or built as an ultra-light device, with efficient and reliable power supply (e.g., driving power directly from electrical grid, and/or by incorporating efficient and/or long lasting 12/24 VDC batteries and/or other batteries and/or power sources). The intelligent smoke sensor 200 may, for example, incorporate one or more sensors. The one or more sensors may be operable to enhance, for example, the smoke/fire/carbon monoxide monitoring and/or detection functions of the intelligent smoke sensor 200. For example, the intelligent smoke sensor 200 may incorporate one or more photoelectric sensors 230 and/or one or more temperature sensors 240. The one or more photoelectric sensors 230 and/or the one or more temperature sensors 240 may provide enhanced detectability of smoke/fire/carbon monoxide, for maximum protection from flaming and/or smoldering fires.

In an example embodiment of the disclosure, the intelligent smoke sensor 200 may incorporate one or more alarm indicators. The one or more alarm indicators may be provided to ensure that the users are more likely alarmed of detected smoke/fire/carbon monoxide. For example, the intelligent smoke sensor 200 may incorporate one or more alarm indicators 250, which may comprise both a visual (e.g., RGB) indicator $\mathbf{250}_A$ and an audio (e.g., 100 dBm built-in siren) indicator $\mathbf{250}_B$.

In an example embodiment of the disclosure, the intelligent smoke sensor 200 may be built utilizing a metal screen (not shown) that may go around the edges of the intelligent smoke sensor 200. In this regard, the metal film may comprise beveled microscopic holes (e.g., the holes may comprise rounded edges) that may allow for an enhanced penetration of the smoke into a smoke chamber (not shown) housed within the intelligent smoke sensor 200 such that, for example, the intelligent smoke sensor 200 may be operable to detect presence of smoke (utilizing various sensors) more accurately (e.g., faster) as compared with traditional smoke detectors.

In an example embodiment of the disclosure, the intelligent smoke sensor 200 may incorporate a wireless range tester (not shown) that may be operable to, for example, determine whether the intelligent smoke sensor 200 is within a range of a home network manager (e.g., home network manager 210). In this regard, the intelligent smoke sensor 200 may be operable to generate an alarm condition when the intelligent smoke sensor 200 is not within a rage on any home network manager (e.g., home network manager 210)

and/or when the intelligent smoke sensor 200 that, for example, was previously within the range of a (e.g., home network manager 210), is now outside of that range. In an example embodiment of the disclosure, the alarm condition may active one or more alarm indicators (e.g., alarm indicators $\mathbf{250}_A$, $\mathbf{250}_B$) to generate indicate an alarm condition by, for example, generating an audible and/or a visual alarm.

In another example embodiment of the disclosure, the home network manager 210 may be operable to generate an alarm condition, when for example, the intelligent smoke sensor that, for example, was previously within the range of the home network manager 210, is now outside of that range.

In an example embodiment of the disclosure, the intelligent smoke sensor 200 may incorporate one or more various features for, for example, particularly providing (and enhancing) recording and/or maintaining of information (e.g., information relating to alarms, alarm conditions and/or detection of smoke/fire/carbon monoxide). For example, the intelligent smoke sensor 200 may incorporate, for example, a data recorder 260. The data recorder 260 may be operable to record data and/or information relating to operation of the intelligent smoke sensor 200. In this regard, the data recorder 260 may comprise suitable circuitry, interfaces, logic, and/or code for obtaining, processing and/or storing of data and/or information. The data and/or information may be related to operation of the intelligent smoke sensor 200 and/or any detected alarms and/or alarm conditions. The recording and/or storing of data may be done in, for example, a continuous manner, periodically, or it may be event-triggered (e.g., whenever an alarm-triggering event is detected).

The alarm-triggering event may comprise, for example, an increase in temperature (e.g., above a pre-defined and/or per-configured threshold(s), rapid increase of temperature, such as, for example, a raise in temperature by more than a pre-defined and/or pre-configured number of degrees during a pre-defined and/or pre-configured time interval), detection of carbon monoxide, detection of smoke, and/or detection of fire.

In some instances, the data recorder 260 may be specifically designed and/or built to survive a fire incident. For example, the data and/or information stored in the data recorder 260 may be recoverable from the data recorder 260 even when, for example, the intelligent smoke sensor 200 is otherwise destroyed during a fire event. Accordingly, the data and/or information regarding a fire event may be recovered and/or used subsequently to a fire event. The data and/or information may be relevant to, for example, investigating one or more causes of the fire event. For example, the data and/or information may comprise the time and date information of when an alarm condition was triggered and/or the temperature measurements before and throughout the fire even (e.g., for determining how rapidly the fire started and/or how rapidly the temperature was rising, whether a fire, carbon monoxide and/or smoke triggered an alarm condition).

In an example embodiment of the disclosure, the intelligent smoke sensor 200 may comprise other suitable circuitry, interfaces, logic, and/or code for implementing various aspects of the present disclosure. For example, the intelligent smoke sensor 200 may comprise a memory and/or a processor.

The memory may store, for example, configuration data, which may comprise parameters and/or code, comprising software and/or firmware. The memory may comprise different memory technologies, including, for example, read-only memory (ROM), random access memory (RAM), low latency nonvolatile memory, flash memory, solid-state drive (SSD), field-programmable gate array (FPGA), and/or other suitable electronic data storage capable of storing data, code and/or other information.

In an example embodiment of the disclosure, the intelligent smoke sensor 200 may be operable to receive software and/or firmware updates. For example, the intelligent smoke sensor 200 may receive software and/or firmware updates from a network manager (e.g., the home network manager 210). In an example embodiment of the disclosure the software and/or hardware updates may be received, processed and/or installed automatically and/or manually. For example, the process may be completely automatic (e.g., a network manager may send an update to the intelligent smoke sensor and the intelligent smoke sensor may process it automatically), semi-automatic (e.g., an update may be initiated by a user through, for example, a network manager and/or through an interface on the intelligent smoke sensor, and may, for example, be processed by the intelligent smoke sensor automatically) and/or manual (e.g., an update may be initiated by a user through, for example, a network manager and/or through an interface on the intelligent smoke sensor, and may, for example, be processed by the intelligent smoke sensor in response to a user action indicative of a desire to install the particular update (e.g., through an interface)).

The processor may comprise suitable circuitry, interfaces, logic, and/or code that may be operable to process data, and/or control and/or manage components, operations and/or functions of intelligent smoke sensor 200, and/or tasks performed therein. In this regard, the processor may configure and/or control operations of various components and/or subsystems of the intelligent smoke sensor 200, such as, for example, the memory, the communication subsystem (e.g., for communicating with, for example, the home network manager 210), the photoelectric sensor(s) 230, the temperature sensor(s) 240 and/or the indicators $\mathbf{250}_A$, $\mathbf{250}_B$, etc. by utilizing, one or more control signals.

In some embodiments, the processor may also automatically detect a malfunction, for example, when the smoke chamber is damaged. For example, the processor may perform a self test periodically, for example, every 5 seconds. If the processor detects a malfunction, the processor may generate an intermittent sound alarm through the indicator 250B. In other embodiments, the processor may also activate both of the indicators 250A and 250B, that is, both visually through the RGB indicator 250A and audibly through the alarm indicator 250B. In some embodiments, the processor may also transmit an alarm signal via the Z-Wave communication protocol to the network manager and any of the associated devices (120*a*-120*k*).

Figure 3:
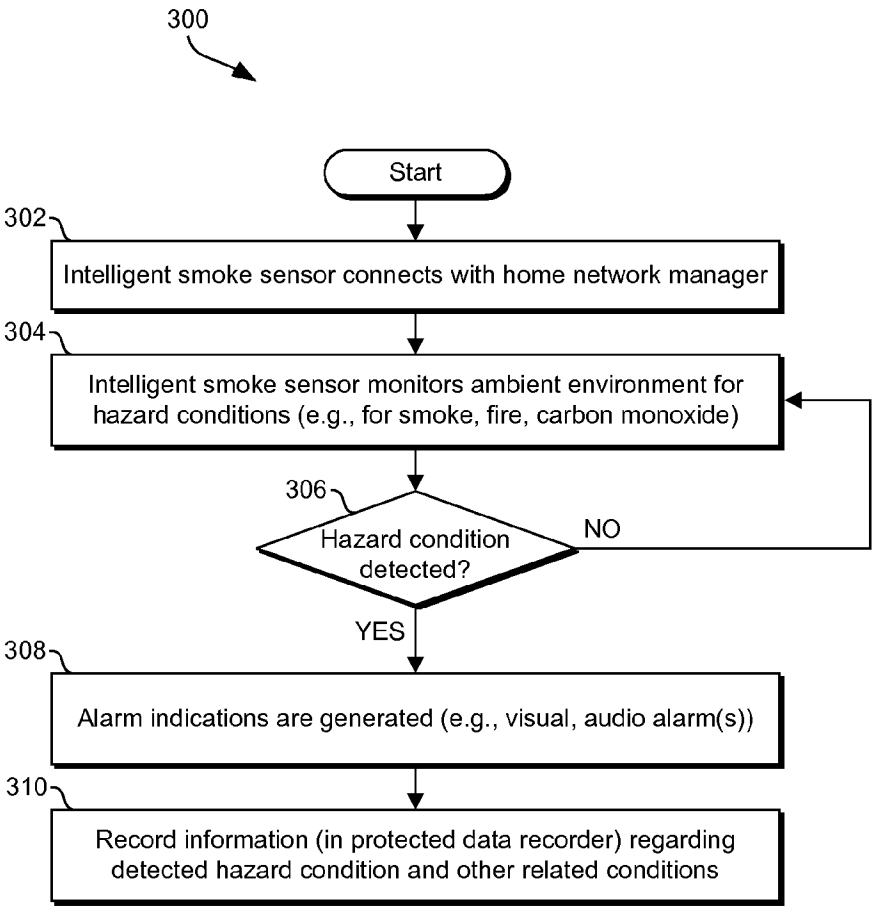
FIG. 3 illustrates an example flow chart of a method for an example process for managing one or more intelligent smoke sensors.

FIG. 3 illustrates an example flow chart of a method for an example process for managing one or more intelligent smoke sensors. Referring to FIG. 3, there is shown a flow chart 300 comprising a plurality of example steps.

In example step 302, an intelligent smoke sensor (e.g., the intelligent smoke sensor 200 as depicted in and/or described with respect to FIG. 2) may connect with a home network manager (e.g., the home network manager 210 as depicted in and/or described with respect to FIG. 2). The connection may comprise a communication link (e.g., the communication link 220 as depicted in and/or described with respect to FIG. 2), such as, for example, a Z-Wave link. The connection may comprise one or more types of wireless and/or wired connections. The connecting may, in some instances, comprise determining whether the intelligent smoke sensor is within range of the home network manager. In this regard, the intelligent smoke sensor may incorporate a wireless range tester for determining whether the intelligent smoke sensor is within a range of a home network manager as described with respect to FIG. 2, for example.

In example step 304, the intelligent smoke sensor may monitor ambient environment close thereto for various hazard conditions, which may comprise, for example, smoke, fire, carbon monoxide and/or other conditions. In this regard, the intelligent smoke sensor may utilize one or more sensors, such as, for example, temperature sensor(s) and/or photoelectric sensor(s), such as for example, sensors depicted in and/or described with respect to FIG. 2.

In example step 306, it may be determined whether a hazard condition is detected, and in instances where no hazard condition is detected, the process may loop back to the example step 304 for continuing and/or periodic monitoring. Returning to the example step 306, in instances where a hazard condition is detected, the process may proceed to example step 308.

In example step 308, alarm indications, pertaining to the detected hazard condition, may be generated. The alarm indications may comprise visual alarm indictors and/or audio alarm indicators.

In example step 310, information regarding detected hazard condition (and other related conditions) may be recorded, particularly in a protected data recorder, which may be specifically designed and/or implemented (as described with respect to FIG. 2, for example) to survive fires and/or other hazardous conditions so as to ensure that the information is not lost.

Other implementations may provide a non-transitory computer readable medium and/or storage medium, and/or a non-transitory machine readable medium and/or storage medium, having stored thereon, a machine code and/or a computer program having at least one code section executable by a machine and/or a computer, thereby causing the machine and/or computer to perform the steps as described herein for an intelligent smoke sensor.

Accordingly, the present method and/or system may be realized in hardware, software, or a combination of hardware and software. The present method and/or system may be realized in a centralized fashion in at least one computer system, or in a distributed fashion where different elements are spread across several interconnected computer systems. Any kind of computer system or other system adapted for carrying out the methods described herein is suited. A typical combination of hardware and software may be a general-purpose computer system with a computer program that, when being loaded and executed, controls the computer system such that it carries out the methods described herein.

The present method and/or system may also be embedded in a computer program product, which comprises all the features enabling the implementation of the methods described herein, and which when loaded in a computer system is able to carry out these methods. Computer program in the present context means any expression, in any language, code or notation, of a set of instructions intended to cause a system having an information processing capability to perform a particular function either directly or after either or both of the following: a) conversion to another language, code or notation; b) reproduction in a different material form.

While the present method and/or apparatus has been described with reference to certain implementations, it will be understood by those skilled in the art that various changes may be made and equivalents may be substituted without departing from the scope of the present method and/or apparatus. In addition, many modifications may be made to adapt a particular situation or material to the teachings of the present disclosure without departing from its scope. Therefore, it is intended that the present method and/or apparatus not be limited to the particular implementations disclosed, but that the present method and/or apparatus will include all implementations falling within the scope of the appended claims.

What is claimed is:

1. A detector comprising:

a smoke sensor configured to determine a presence of smoke;

a temperature sensor configured to measure temperature;

a processor configured to communicate with the smoke sensor and the temperature sensor, wherein the processor is configured to generate a first alarm indication based on at least one of the presence of smoke or the temperature exceeding a pre-configured threshold;

a wireless transceiver configured to communicate the alarm indication over a wireless network with a home network manager;

a recorder configured to record:

the presence of smoke at a first time, the temperature at the first time, and a value of the first time; and the presence of smoke at a second time, the temperature at the second time, and a value of the second time;

a range tester configured to determine whether the wireless transceiver is connected to the wireless network and generate a second alarm indication if the wireless transceiver is not connected to the wireless network;

an audio indicator configured to be activated in response to at least one of the first alarm indication or the second alarm indication; and a visual indicator configured to be activated in response to at least one of the first alarm indication or the second alarm indication.

2. The detector of claim 1, wherein recording, by the recorder, is triggered by an event of detecting the presence of smoke.

3. The detector of claim 1, wherein the processor is configured to perform a malfunction test to determine whether the detector is malfunctioning and to responsively generate a third alarm indication if the detector is malfunctioning, whereby at least one of the audio indicator or visual indicator is activated in response to the third alarm indication.

* * * * *